US005299693A

United States Patent [19]

Ubaldi et al.

[11] Patent Number: 5,299,693

[45] Date of Patent: Apr. 5, 1994

[54] METHOD AND APPARATUS FOR EXTRACTING SELECTED MATERIALS

[76] Inventors: Richard A. Ubaldi, 12 Agatha La., Wayne, N.J. 07470; Garrett A. Smith, R.R. #1, Box 282, Pickle Rd., Califon, N.J. 07830; Mark W. Hrehovcik, 115 Cedar Grove Rd., Little Falls, N.J. 07424; Douglas P. Rauen, 1809 SW. Parkview Ct., Portland, Oreg. 97212

[21] Appl. No.: 928,914

[22] Filed: Aug. 11, 1992

Related U.S. Application Data

[63] Continuation-in-part of Ser. No. 684,673, Apr. 12, 1991, abandoned.

[51] Int. Cl.[5] ..... B07C 5/344

[52] U.S. Cl. ..... 209/3.3; 209/3.1; 209/571; 209/930; 901/7; 901/35; 198/341; 198/444

[58] Field of Search ..... 209/3.1, 3.2, 3.3, 569, 209/571, 583, 930; 901/7, 35; 198/444, 341

[56] References Cited

U.S. PATENT DOCUMENTS

| | | | |
|---|---|---|---|
| 3,283,918 | 11/1966 | Devol | 198/341 X |
| 3,623,603 | 11/1971 | Casner et al. | 209/3.3 |
| 3,722,172 | 3/1973 | Seragnoli | 53/54 |
| 3,849,633 | 11/1974 | Reitboeck et al. | 200/3.3 X |
| 3,888,362 | 6/1975 | Fletcher et al. | 901/35 X |
| 4,527,326 | 7/1985 | Kohno et al. | 198/444 |
| 4,805,778 | 2/1989 | Nambu | 209/3.3 |
| 4,949,528 | 8/1990 | Palik | 209/930 X |
| 4,986,410 | 1/1991 | Sheilds | 198/444 |
| 5,033,623 | 7/1991 | Grecksch et al. | 209/33 |
| 5,048,694 | 9/1991 | Iwamoto | 209/540 |
| 5,072,833 | 12/1991 | Hansen et al. | 209/33 |
| 5,100,005 | 3/1992 | Noble et al. | 200/930 X |

FOREIGN PATENT DOCUMENTS

| | | | |
|---|---|---|---|
| 0412351 | 2/1991 | European Pat. Off. . | |
| 2139700 | 6/1987 | Japan | 209/33 |
| 9101818 | 2/1991 | World Int. Prop. O. | 209/583 |

OTHER PUBLICATIONS

Artley, John W., "Automated Visual Inspection Systems Can Boast Quality Control Affordability," I. E. Dec. 1982, pp. 20–32.

*Primary Examiner*—D. Glenn Dayoan
*Assistant Examiner*—Dean A. Reichard
*Attorney, Agent, or Firm*—Michael E. Marion

[57] ABSTRACT

An apparatus for removing recyclable or other selected items from a load of mixed trash. An identifier generating a non-visual identifying signal is secured to the item and is used in conjunction with sensor devices to locate the position of the item anywhere within the load of mixed trash, to control the movement of the load along a conveyor to an extracting device, to control the movement of the extracting device and the operation of the extracting device so as to remove the selected item from the load without human intervention and under automated control.

6 Claims, 3 Drawing Sheets

METHOD AND APPARATUS FOR EXTRACTING SELECTED MATERIALS

This application is a continuation-in-part of U.S. patent application Ser. No. 684,673, filed Apr. 12, 1991 now abandoned.

BACKGROUND OF THE INVENTION

Many municipal programs, designed to separate recyclable materials from mixed municipal solid waste, especially the solid waste arising from residences, currently rely upon collection schemes in which a separate truck, on a separate route, must be sent out to collect the recyclables. This type of program to acquire the recyclables incurs significant extra costs over and above the normal refuse collection.

One current scheme for eliminating multiple collections involves separation and placement of recyclables by the resident into special containers which are usually the color blue. These containers can be for example, bags similar in construction to garbage bags. Containers which are selectively coded for such recycling will be collectively referred to hereinafter as "blue bags". The blue bags are usually set out on the curb alongside the regular garbage. The collection truck crew then places the blue bags containing the recyclables in the ordinary truck together with the regular garbage.

U.S. Pat. No. 5,100,005 to Noble teaches describes a method and apparatus for separating bags of recyclable materials from bags of ordinary trash by detecting bar codes placed on the bags of recyclable materials which are placed upon a conveyer belt along with the bags of ordinary trash. Noble however, relies on visually perceptable coding and identification means (i.e. bar codes) which are adequate for his application.

If however, recyclables (for example the "blue bags") are mixed together with ordinary trash to form larger loads of mixed trash, Noble's invention would be ineffective because his bags could be disposed anywhere within the three dimensional space of the load of mixed trash and thus not be detectable using sensors only sensitive to visually perceptable signals.

When a load of mixed trash (i.e. one in which recyclables and non-recyclables are mixed together) arrives at the transfer station or disposal site, the recyclables (for example the "blue bags") must be manually removed from the non-recyclable garbage. This method of manually separating the blue bags is labor intensive and therefore expensive. It also poses significant health risks to the worker who must manually sift through the garbage to separate the recyclables.

One object of the instant invention therefore, is to provide a method for separating recyclable materials from a load of mixed trash containing both recyclable and non-recyclable materials, in a quick and safe manner.

It is another object of the instant invention to provide an apparatus for separating recyclable materials from mixed trash in a substantially automated fashion and without the use of human labor.

SUMMARY OF THE INVENTION

The invention comprises a method and apparatus for automatically identifying an extracting the recyclables such as blue bags from a load of mixed trash. In particular, the instant invention permits the detection and removal of the recyclables from the mixed trash even when a recyclable is disposed within the mixed trash in a manner which makes it visually undetectable. This feature of the invention allows the collection of trash to be less complicated, and thus less costly, since it avoids the need to sort the identified recyclables from the non-recyclable trash prior to collection.

Inexpensive, recyclable identifying tags of the type currently in use in the retail store security industry to identify merchandise at store exits, are combined with, or otherwise attached to bags containing recyclables, or to the recyclables themselves when practical, to facilitate their detection and positional location within a stream of mixed trash placed, for example, on a moving conveyer belt, and their removal from the mixed trash under programmed control.

The preferred embodiment of the invention comprises a system consisting of a number of modules, including:

(1) one or more blue bags which each incorporate an identifier which enables the blue bag to be recognized and positionally located automatically within the load of mixed trash;

(2) an Identification Module consisting of an array of sensors to detect the presence and position of identifiers anywhere within the three dimensional space occupied by the mixed trash stream;

(3) a Control Module comprising a programmable processor, for example a small computer or microprocessor system, for system control;

(4) an Actuator comprising one or more end effectors (for example robot arms) under the control of the Control Module and responsive to further location data provided by a Proximity Sensing Module;

(5) a Proximity Sensing Module comprising a further number of sensors mounted on or near the end-effector(s) of the Actuator, to provide final fine-scale instructions needed to guide the end-effector precisely to a blue bag; and (6) a Conveyor Control Module which comprises a motor-control device that, in conjunction with the Control Module, regulates the speed of the conveyor upon which the mixed trash is moving.

The instant invention improves upon the current economies of using a single collection for both non-recyclable trash and recyclables. A single collection significantly reduces labor costs, capital costs for additional collection equipment, operating and maintenance costs while providing environmental improvements derived through reduced emissions and fuel consumption.

The invention also reduces the safety and health hazards associated with manual picking of the recyclables from the mixed trash that is inherent when workers are exposed to raw dirty mixed trash. Such exposure includes dust, airborne disease organisms and potential cuts and bruises from hand picking.

The instant invention substantially eliminates the labor costs associated with manual picking, thereby resulting in major operating cost savings.

A feature of the preferred embodiment of the instant invention is that it uses a relatively inexpensive blue bag which can be easily modified to include known types of identifiers, and recycled for maximum cost and environmental efficiency.

It is another feature of the invention that it utilizes a programmable end-effector, for example a robot arm, to extract the blue bag from a mixed stream of trash.

It is a still further feature of the invention that it utilizes a speed controlled conveyor system to facilitate the extraction of the identified blue bags.

It is another feature of the invention that it uses both a broad location sensor array and a fine positional sensor array for locating the precise position of the recyclable anywhere within the three dimensional space occupied by the mixed trash stream.

It is yet another feature of the preferred embodiment of the invention that it utilizes means for generating and detecting non-visual identifying signals so that recyclables can be detected and removed from the mixed trash even when they are buried within the non-recyclable trash in a manner which would be undetectable by optical (visual) examination alone.

These and other objects and features of the invention will be more fully appreciated from the following detailed description when taken in conjunction with the accompanying drawings, in which:

BRIEF DESCRIPTION OF THE DRAWINGS

FIGS. *2a–2c* describes the three dimensional coordinate system defining the surface area of the conveyor system shown in FIG. 1.

DETAILED DESCRIPTION OF PREFERRED EMBODIMENTS OF THE INVENTION

Figure 1:
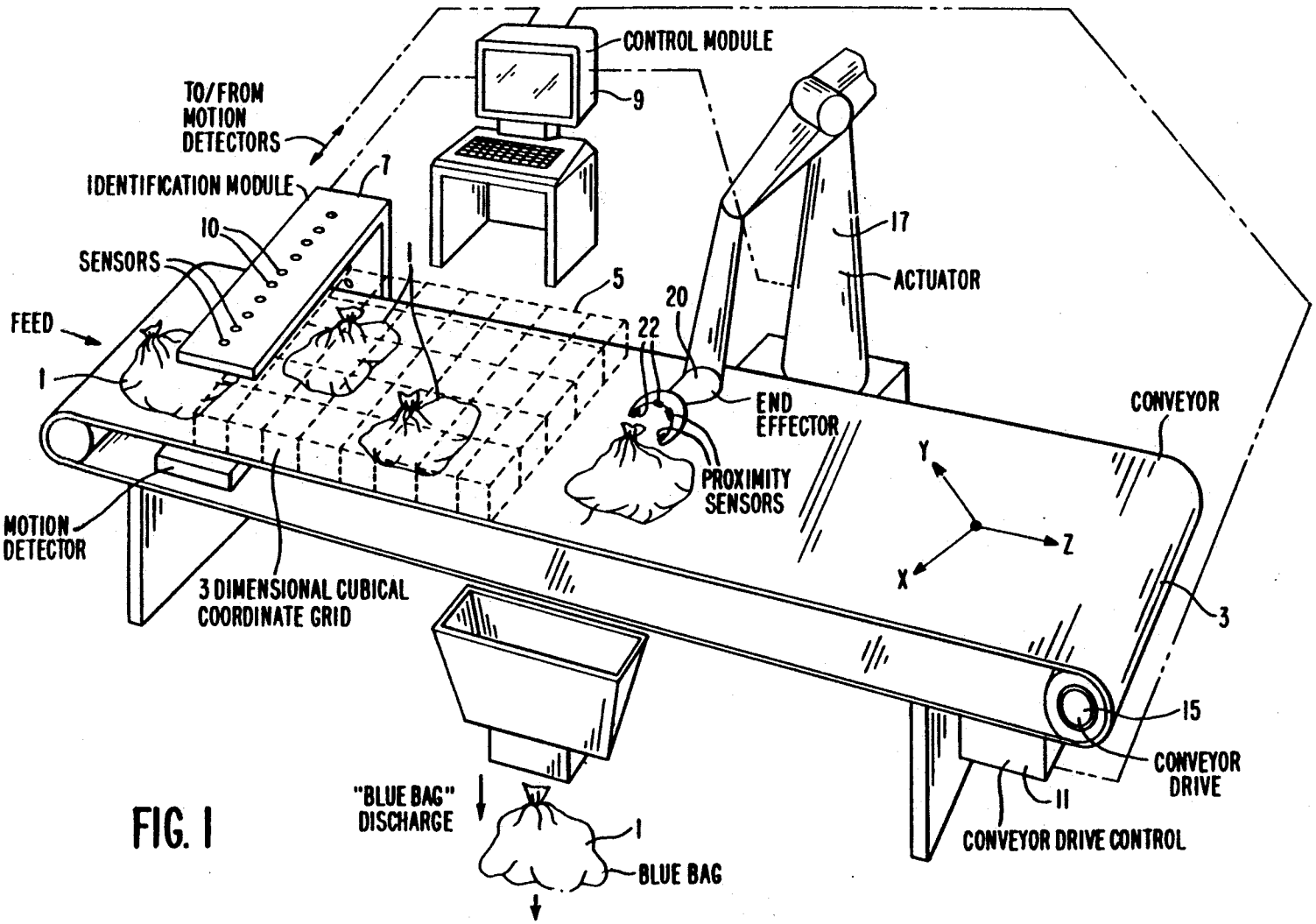
FIG. 1 describes an embodiment of automatic removal system in accordance with the invention.
Figure 2A:
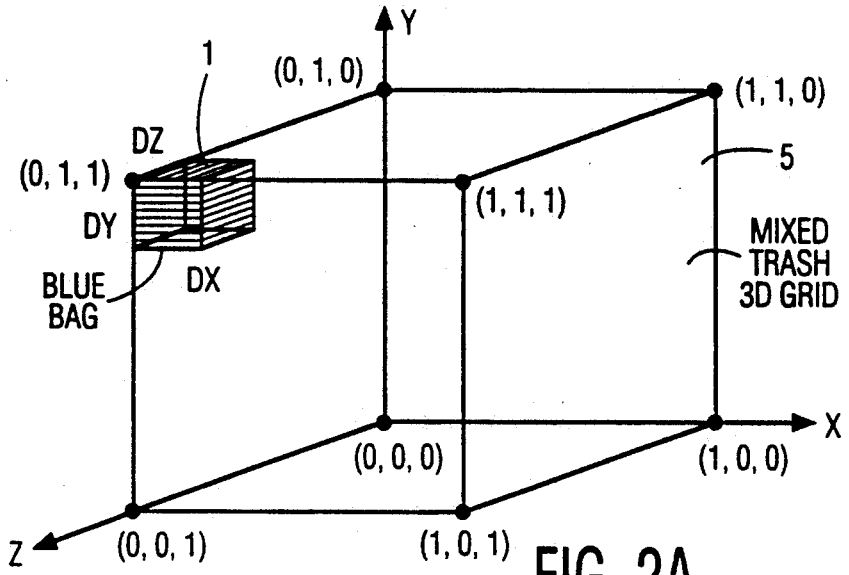
Figure 2B:
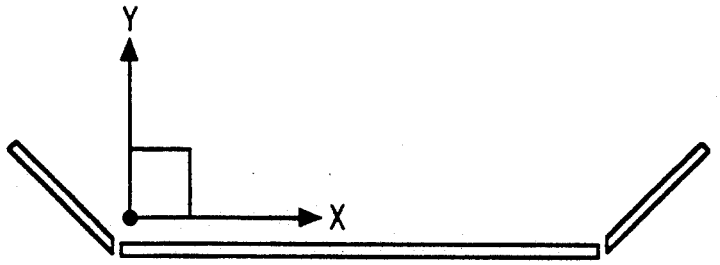
Figure 2C:
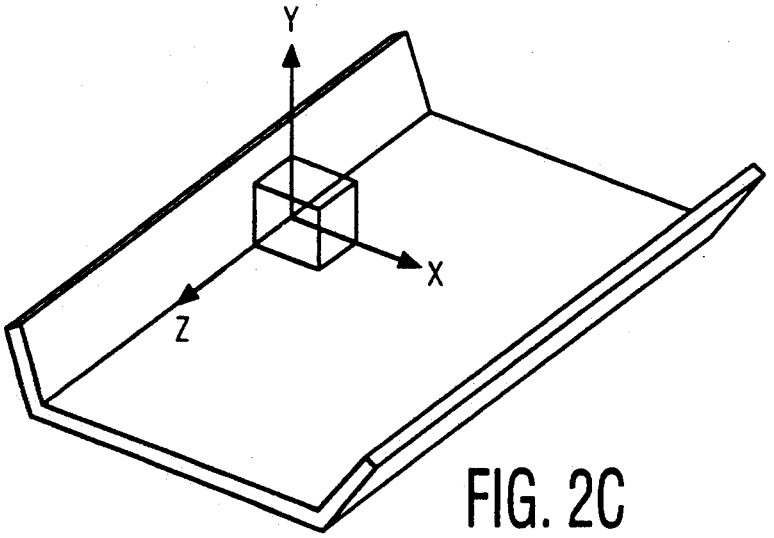

An apparatus comprising a preferred embodiment of the invention is shown in FIG. 1. A mixture of mixed trash containing blue bags 1 is loaded onto a single or variable speed conveyor 3. The depth of the trash stream can be kept relatively constant by controlling the speed of the conveyor 3 during the loading operation or through the use of multiple infeed conveying systems operating at different speeds. Because the blue bags 1 will be randomly located within the refuse prior to being metered onto the conveyor, they will continue to be randomly located across and along the conveyor 3.

In order to identify and locate the blue bags 1 with the trash stream, the surface area of the conveyor 3 is analysed by dividing it into a three dimensional cubical coordinate grid 5. The grid defines the spatial position in which the blue bags 1 are located. Each of the blue bags 1 used with the invention are manufactured or otherwise adapted to comprise an identifier. The identifier can be designed to be part of the blue bag and marketed with the bag as a single item. Suitable bags of this type are similar to standard kitchen bags manufactured by companies such as First Brands Corp., Danbury, Conn. The identifier can consist of a disposable printed circuit designed to conduct eddy currents whose fields will return characteristic non-visual signals that can be recognized by the identification module as described below. Printed circuits of this type are manufactured by companies such as Checkpoint Systems, Thorofare, N.J. and are used in similar form in retail stores as security sensors for merchandise.

In accordance with the invention, the identifier can be manufactured as an integral part of the blue bag, such as by printing directly on the bag with electrically conductive ink. However, the identifier will function equally well if made as part of an external label, patch or tag.

The identification module 7 comprises a plurality of sensors 10 disposed in a manner which will allow the detection of a blue bag anywhere within the three dimensional coordinate system as shown for example, in FIGS. *2a–2c*. Although the identification module 7 is shown with sensors 10 placed above and to one side of the area defined by the coordinate system (along the x and y axis), it is to be understood that for defining a three dimensional location, sensors can be placed at other positions with respect to the conveyor surface as well. The use of the non-visually dependant sensing means described above permits the detection of an identifying signal from an identifier attached to a blue bag disposed anywhere within the three dimensional space occupied by the mixed trash stream including under the surface of the mixed trash stream in a manner which renders it visually unobservable.

The sensors 10 of the identification module 7 are continually scanned by the control module 9. A multiplexer can be used as part of the identification module to sequentially scan each sensor 10. When the identification module 7 detects a blue bag identifier, a signal is sent to the control module 9. Each detection or "hit" establishes a precise time and location along the z axis of the grid. By knowing its position in time on the grid, the control module 9 registers ("time-stamps") the hit. As sensors 10 placed along the x and y axis are sampled by the multiplexer, a hit at specific sensors 10 also provide the location of the blue bag along the x and y axis of the grid and the activated sensors 10 send signals to the control module 9 which registers ("location-stamps") the hit.

The conveyor drive control 11 increases the efficiency of the entire system by either speeding up or slowing down the conveyor drive 15 as a function of the density of blue bags 1 across and along the conveyor 3. The control module 9 receives signals from the conveyor drive control 11 which enable the control module to compute the speed and future grid position of the detected blue bag. Using the time stamp and conveyor speed, the control module 9 can determine the time at which the blue bag will reach a grid coordinate location accessible to the actuator 17 which in the illustrated embodiment is a robot arm. The control module 9 sends coordinates to the actuator 17 reflecting the positional information (x and y axis) of the blue bag. The control module 9 processes the signals received from the conveyor drive control 11 and the identification module 7 and provides instructions to the actuator 17 that takes into account the movement of the conveyor along the z axis of the grid between the sensors 10 in the identification module 7 and the sensors 22 in the end effector 20. Thus, the control module 9 can predict where the detected blue bags 1 will be at the time (t) and therefore its position along the z axis, enabling the actuator 17 to place its end effector 20 in a grid position proximate to the blue bag.

The control module 9 also instructs the conveyor drive control 11 to direct the conveyor drive 15 to change velocity in accordance with system demands, for example, to slow down to allow the actuator 17 the proper time to extract the blue bags 1 (as described below) and in response to a high density of blue bags 1 as identified by the identification module 7. Conversely, the control module 9 instructs the conveyor drive control 11 to increase the speed of the conveyor drive 15 up when fewer blue bags 1 are recognized.

Figure 3:
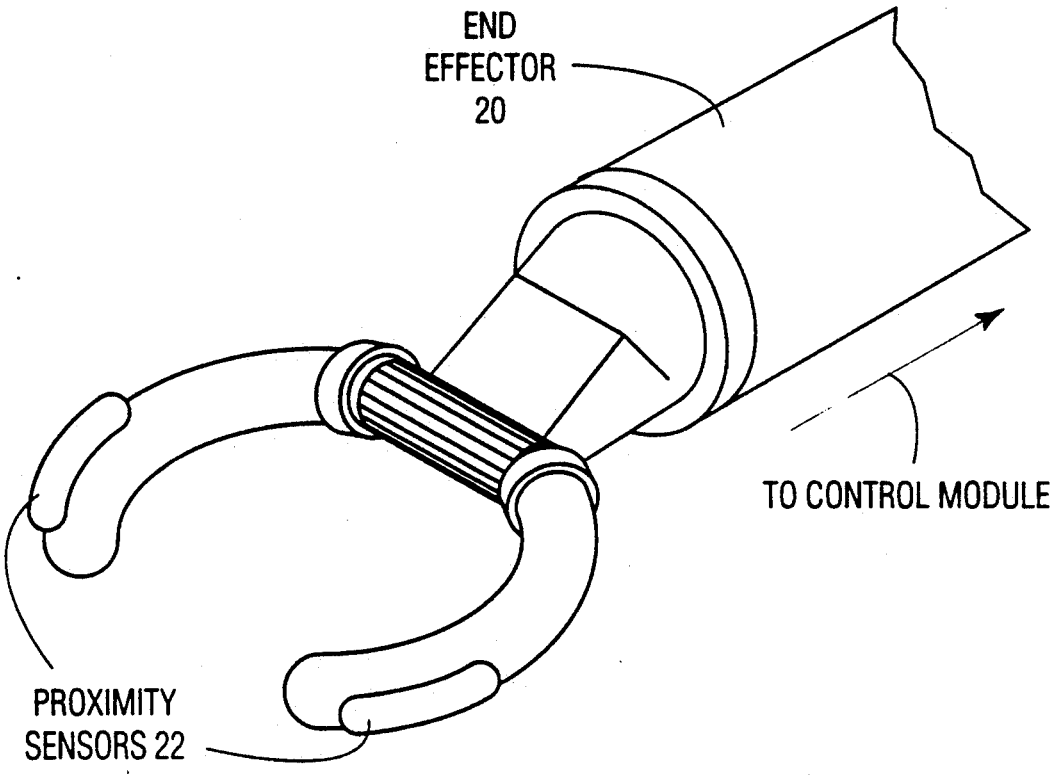
FIG. 3 is a more detailed view of the end effector shown in FIG. 1.

As shown more clearly in FIG. 3, the end effector 20, which in the illustrated preferred embodiment is a robot arm, is equipped with one or more proximity sensors 22 similar to sensors 10 except possibly smaller in size. When the sensors 22 detect the close proximity of a blue bag 1, they generate further signals to the control module 9, which according to the number of sensors 22 can be directional in nature. As the signal from the sensors 22 becomes stronger or weaker, the control module 9 will cause the actuator 17 and end effector 20 to perform fine scale movements to "home in" on the blue bag 1. This continuous exchange of information to control motion in a desired manner constitutes a feedback loop resembling the action of the final, close-in, prey-seeking system of a shark, in which nerve endings sensitive to the electric fields set up by the muscles of a prey animal are arranged in a ring around the mouth of the shark, enabling it to locate and bite at the proper moment, even when the prey is too close for the shark to see. When a predetermined signal intensity is reached, the control module 9 will cause the end effector 20 to grasp the bag and physically extract it from the mixed trash. By this means, the invention provides for the blue bags 1 to be separated, sorted and placed into an alternate desired accumulation for final processing by others.

The identification module 7 consists of an array of sensors 10 which excite small electric currents in a circuit printed on or attached to the blue bag 1 and immediately thereafter detect the presence of such currents to identify the object with which the circuit is associated. Similar devices are used as proximity sensors 22 on the end effector 20. Such devices are available for example, as part of the Checkpoint Systems Portable Verifier unit sold by Checkpoint Systems, Inc. Detection of anti-theft tags comprising a printed circuit as described above and sold by Checkpoint for use with the Verifier, will complete a circuit, signaling the control module 9. This allows confirmation of the exact location of an identifier without physical or visual contact.

Although other types of non-visually dependent identifiers/sensors are within the scope of the invention, there are significant advantages in utilizing the Checkpoint or equivalent devices. These include low cost and recyclability.

Conveyors capable of carrying refuse are currently being manufactured by companies such as B&L Industrial Services, Burlington, N.J.

The actuator 17 and end effector 20 can be implemented with an industrial grade robotic device capable of pushing, picking up, selectively diverting to one side, selectively dropping, or otherwise subjecting blue bags 1 to the physical motion necessary to extract them, under the control of a programmed processing device such as control module 9. For example, multi-axis, extendable reach robot arms capable or picking blue bags 1 off a moving belt variable speed conveyor are available from companies such as ABB Combustion Engineering Systems, Roseland, N.J.

The following Table I represents a flow summary of a preferred embodiment of the process in accordance with the invention.

The foregoing disclosure and description of the invention is illustrative and explanatory thereof and various changes in the size, shape and materials as well as in the details of the illustrated construction may be made within the scope of the appended claims without departing from the spirit of the invention.

TABLE I

BLUE BAG REMOVAL PROCESS

| DETAIL OF METHOD | NOTES |
|---|---|
| 1. Turn unit on | |
| 2. Control module initiation | |
| 3. Conveyor set to standard speed | |
| 4. Check sensor module | |
| 5. Check multiplexor | |
| 6. Check and initialize actuator | |
| 7. Place garbage on conveyor | |
| 8. Conveyor transport garbage through sensors | |
| 9. Circuit is completed when blue bag is detected | Bag number 1 |
| 10. Sensor send signal to multiplexor | One multiplexor could handle all sensors |
| 11. Multiplexor location stamps and time stamps sensor signal | |
| 12. Control module scans multiplexor | |
| 13. Control module reads multiplexors information | |
| 14. Control module calculates time for blue bag to reach actuator | |
| 15. Control module send time and location and speed of conveyor to actuator | |
| 16. Conveyor continues to move garbage | |
| 17. Actuator waits for bag | |
| 18. Sensor continues to inspect garbage | This is an ongoing process |
| 19. Another bag is detected | Bag number 2 |
| 20. Circuit is completed when blue bag is detected | |
| 21. Sensor send signal to multiplexor | |
| 22. Multiplexor location stamps and time stamps sensor signal | |
| 23. Control module scans multiplexor | |
| 24. Control module reads multiplexors information | |
| 25. Control module calculates to determine if conveyor should slow down | Bag number 3 |
| 26. Sensor detects another bag | |
| 27. Circuit is completed when blue bag is detected | |

TABLE I-continued

| BLUE BAG REMOVAL PROCESS | |
|---|---|
| DETAIL OF METHOD | NOTES |
| 28. Sensor send signal to multiplexor | |
| 29. Multiplexor location stamps and time stamps sensor signal | |
| 30. Control module scans multiplexor | |
| 31. Control module reads multiplexors information | |
| 32. Control module calculates to determine if conveyor should slow down | Removal of bag number one starts here |
| 33. Bag number one reaches actuator | |
| 34. Actuator moves with conveyor in a downward motion | |
| 35. Proximity sensor sense bag | |
| 36. Proximity sensor sends signal to control module | |
| 37. Control module sense signal to end effector | |
| 38. End effector pinches bag | |
| 39. Control modules checks to see if proximity sensor has a completed circuit | |
| 40. Control module send blue bag discharge location to actuator | |
| 41. Actuator discharges bag | |
| 42. Conveyor continues to move garbage | |
| 43. Control modules send time and location and speed of conveyor to actuator | Removal of Bag number 2 starts here |
| 44. Bag number two reaches actuator | |
| 45. Actuator moves with conveyor in a downward motion | |
| 46. Proximity sensor sense bag | |
| 47. Proximity sensor sends signal to control module | |
| 48. Control module sense signal to end effector | |
| 49. End effector pinches bag | |
| 50. Control module checks to see if proximity sensor has a completed circuit | |
| 51. Control module sends blue bag discharge location to actuator | |
| 52. Actuator discharges bag | Bag number three is too close to actuator to reset. Conveyor must slow down. |
| 53. Conveyor continues to move garbage | |
| 54. Control module determined that the conveyor must slow down to pick up bag number three | |
| 55. Control module send new speed to conveyor module | |
| 56. Conveyor slows down | |
| 57. Control module send time and location and speed of conveyor to actuator | |
| 58. Bag number three reaches actuator | |
| 59. Actuator moves with conveyor in a downward motion | |
| 60. Proximity sensor sense bag | |
| 61. Proximity sensor sends signal to control module | |
| 62. Control module sense signal to end effector | |
| 63. End effector pinches bag | |
| 64. Control module checks to see if proximity sensor has a completed circuit | |
| 65. Control module send blue bag discharge location to actuator | |
| 66. Actuator discharges bag | |
| 67. Control module send signal to conveyor module to reset conveyor to original speed. | |
| 68. conveyor module reset conveyor to original speed | This process is ongoing the control module will only send one blue bag info to the actuator at a time. |
| 69. Conveyor speeds up | |
| 70. Process continues until all garbage is scanned | |

We claim:

1. An apparatus for locating and separating recyclable items from a quantity of mixed trash comprising a number of recyclable items disposed within a quantity of non-recyclable items, said apparatus comprising in combination:

a) identifying means coupled to each of said recyclable items, for providing respective non-visual identifying signals;

b) first locating means for locating the position of a selected recyclable item within said quantity of mixed trash by detecting its respective non-visual identifying signal thereby providing a first location signal;

c) extracting means for removing said selected recyclable item from said mixed trash;

d) means for effecting relative motion between said quantity of mixed trash, said first locating means and said extracting means in response to said first location signal;

e) second locating means for providing a second location signal in response to said non-visual identifying signal; and f) means for effecting further relative motion between said extracting means and said selected recyclable item in response to said second location signal.

2. The apparatus of claim 1 wherein said identifying means comprises an electrical circuit.

3. The apparatus of claim 1 wherein said first location signal represents the location of the selected recyclable item within the three dimensional space formed by a portion of said mixed quantity of trash.

4. The apparatus of claim 3 wherein said second location signal represents the distance between said extracting means and said selected recyclable item.

5. An apparatus for locating and removing a recyclable item disposed within a quantity of non-recyclable material in a manner such that said item cannot be located visually, said apparatus comprising:

a) means coupled to said item, for providing a non-visual identifying signal;

b) means for detecting the location of said item within said quantity of material in response to its respective non-visual identifying signal so as to provide a first location signal;

c) means for effecting relative motion between said quantity of material, said detecting means and an extracting means for removing said item from said quantity of material;

d) means coupled to said extracting means, for providing a second location signal with respect to said item; and e) means coupled to said detecting means, for controlling said relative motion of said item with respect to said extracting means in response to said first location signal and the position of said extracting means with respect to said item in response to said second location signal.

6. A method for locating and removing a recyclable item equipped to generate a non-visual identifying signal disposed within a quantity of non-recyclable material in a manner such that said item cannot be located visually, said method comprising the steps of:

a) detecting the location of said item within said quantity of material in response to its respective non-visual identifying signal so as to provide a first location signal;

b) effecting relative motion between said quantity of material and an extracting means for removing said item from said quantity of material;

c) controlling said relative motion of said item with respect to said extracting means in response to said first location signal;

d) providing a second location signal with respect to said item and said extracting means; and e) controlling the position of said extracting means with respect to said item in response to said second location signal.

* * * * *